US006262650B1

(12) United States Patent
Norte

(10) Patent No.: US 6,262,650 B1
(45) Date of Patent: Jul. 17, 2001

(54) COIL FORMER

(75) Inventor: David A. Norte, Westminster, CO (US)

(73) Assignee: Avaya Technology Corporation, Basking Ridge, NJ (US)

( * ) Notice: Subject to any disclaimer, the term of this patent is extended or adjusted under 35 U.S.C. 154(b) by 0 days.

(21) Appl. No.: 09/538,048

(22) Filed: Mar. 29, 2000

(51) Int. Cl.[7] ..... H01F 27/28
(52) U.S. Cl. ..... 336/182; 336/198
(58) Field of Search ..... 336/198, 208, 336/234, 212

(56) References Cited

U.S. PATENT DOCUMENTS 3,668,586 * 6/1972 Horbach ..... 336/210
3,939,450 * 2/1976 Donnelly ..... 336/90
4,117,588 10/1978 Johnson .
4,454,554 * 6/1984 Coleman ..... 361/41
4,758,808 7/1988 Sasaki et al. .
4,916,424 * 4/1990 Kijima ..... 336/160
5,396,211 * 3/1995 Noguchi et al. ..... 336/92
5,534,839 * 7/1996 Mackin et al. ..... 336/192
5,861,790 1/1999 Johnson, Jr. et al. .

* cited by examiner

*Primary Examiner*—Karl D. Easthom
*Assistant Examiner*—Richard K. Lee
(74) *Attorney, Agent, or Firm*—Duft, Graziano & Forest, P.C.

(57) ABSTRACT

A coil former for constructing coil transformers. The coil former comprises a rectangular casing having a central interior cavity. The casing is configured to form the coil for the transformer and connect and align a pair of transformer cores to form a substantially homogeneous transformer core. The casing is further configured to connect the coil leads to the homogeneous transformer core to produce a coil transformer.

9 Claims, 4 Drawing Sheets

COIL FORMER

FIELD OF THE INVENTION

The invention relates to coil transformers, and in particular, to a coil former for coil transformers.

PROBLEM

In the art of coil transformers there exists a need for a coil former for a certain class of multi-layer coil transformers. Coil transformers typically include a pair of "E" shaped ferrite transformer cores (E-cores), a plastic housing, and a coil. The E-cores have a center leg and two outer legs equally spaced apart. The E-core legs are configured in a facial relationship with the coil wound around the center legs. The coil leads are soldered onto metallic pins molded into the plastic housing. The metallic pins are used to mount the coil transformer on a printed circuit (PC) board by either a through hole mount or a surface mount.

The plastic housing is a two piece housing, with a first piece connected around the exterior edge of one of the E-cores and a second piece connected around the exterior edge of the other E-core. In a typical assembly, a metallic clip connects around one end of the housing to fasten the housing pieces and E-cores in the facial relationship. A bonding agent such as glue, is used on the opposite end between abutting faces of the outer legs of the E-cores to form a completed coil transformer. In other examples, the clip is replaced by a bonding agent between abutting faces of both pairs of outer legs.

In the transformer art, alignment of the E-core legs during assembly is critical because transformer inductance is directly proportional to the contact between the cross section of the legs. Transformer performance is also affected by air gaps induced by the bonding agent or glue between abutting faces of the E-core legs.

Recent improvements in the art of coil transformers have led to the development of a new transformer E-core that incorporates the PC board mounting apparatuses into the E-cores. These new E-cores allow a stacked mounting configuration of two transformers on a PC board. These new transformers are known as multi-layer coil transformers as described in U.S. Pat. No. 5,861,790.

SOLUTION

The present invention advances the art by providing a coil-former for multi-layer coil transformers. A first advantage of the present coil former is that it provides a form to wind the transformer coil to construct a multi-layer coil transformer. A second advantage of the present coil former is that it provides a means for connecting and aligning the transformer E-cores during assembly to produce a substantially homogeneous transformer core without the use of bonding agents or clips. The substantially homogeneous transformer core is especially advantageous in that it yields improved inductance capabilities over prior art transformers. A third advantage of the present coil former is that it provides a means for connecting the coil leads to the homogeneous transformer core without interfering with the stackable configuration of the multi-layer coil transformers. A fourth advantage of the present coil former is that in some examples the coil former may also provide the connecting apparatus for mounting the transformer to a PC board. This is especially advantageous because it permits the use of the present coil former to construct both non-stackable transformers similar to prior art transformers and multi-layer transformers, both of which have improved inductance characteristics.

The coil former comprises a rectangular casing with a central interior cavity formed through the casing. The casing includes a pair of channels integrally formed and circumscribing the outer diameter of the casing in perpendicular orientation with respect to the cavity. A first plurality of metallic pins connected perpendicular to the casing in parallel orientation with the cavity connect the E-cores to form the homogeneous transformer core. The metallic pins also provide an electrical link for connecting the coil leads to the transformer core.

In a first example of the coil former, the case includes a pair of flanges integrally formed along a first and second edge to align the E-cores during assembly. In another example of the coil former, the case includes a second pair of flanges integrally formed along a third and fourth edge to add improved alignment and add additional structural integrity to the assembled coil transformer. In another example of the coil former, the second pair of flanges includes a plurality of metallic pins for additional structural integrity. In another example of the coil former, the flanges include flared ends to provide additional structural integrity to the assembled coil transformer. In another example of the coil former, a second plurality of metallic pins are connected to the casing in a perpendicular relationship to the first plurality of metallic pins to connect a non-stackable transformer core to a PC board.

DETAILED DESCRIPTION

The invention summarized above and defined by the enumerated claims may be better understood by referring to the following detailed description, which should be read in conjunction with the accompanying drawings. This detailed description is not intended to limit the enumerated claims, but to serve as a particular example thereof. In addition, the phraseology and terminology employed herein is for the purpose of description, and not of limitation.

Multi-layer Transformer Cores

Figure 1:
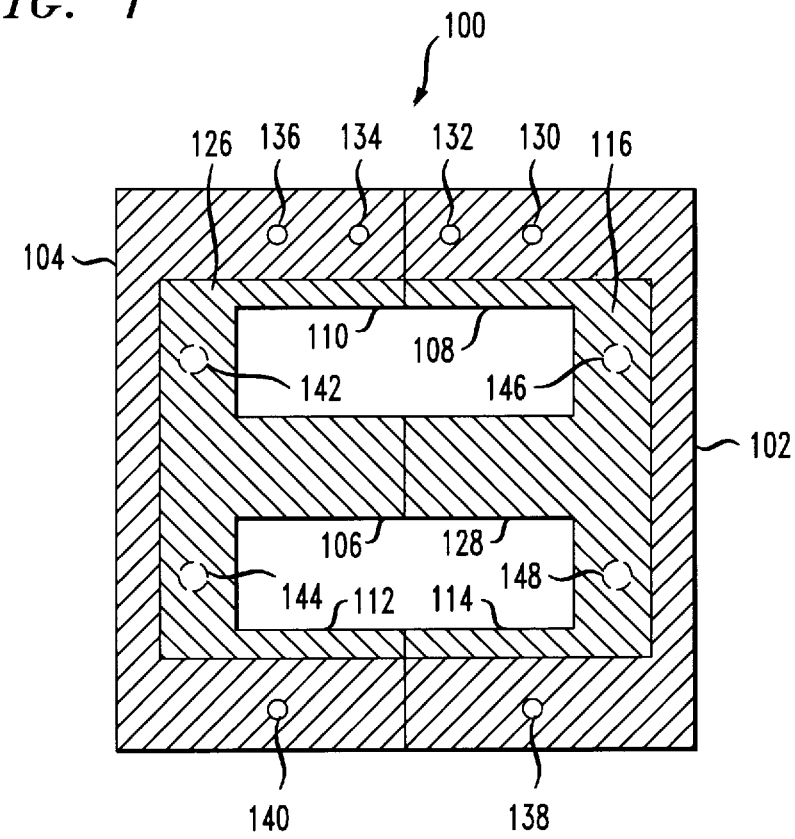
FIG. 1 illustrates a top plan view of a multi-layer transformer core.

FIG. 1 depicts a top plan view of a multi-layer transformer core 100 for a multi-layer coil transformer. Transformer core 100 comprises a pair of ferrite transformer E-cores, 102 and 104. E-core 102 comprises center leg 128 and outer legs 108 and 114 spaced equally apart from center leg 128. E-core 102 includes recessed portions on opposing faces as exemplified by recessed portion 116. E-core 104 is a mirror image of E-core 102 and comprises center leg 106, outer legs 110 and 112, and recessed portion 126. E-cores 102 and 104 are configured in a facial relationship relative to legs 106, 110, 112, and legs 128,108, and 114.

A coil formed by the coil former of the present invention circumscribes center legs 106 and 128 to form a completed multi-layer coil transformer. The recessed portions 126 and 116 in combination with the recessed portions on the opposing sides of E-cores 102 and 104 form larger recessed portions in transformer core 100. The larger recessed portions accommodate the additional height added by the coil to permit stacking of at least two multi-layer coil transformers.

Electrical vias comprise holes or channels through E-cores 102 and 104 which are filled in by a conductive material and covered by solder pads 130, 132, 134, 136, 138, and 140. Electrical vias and solder pads 130, 132, 134, 136, 138, and 140 provide an electrical connection for another transformer stacked on top of transformer core 100. Electrical vias and solder pads 130, 132, 134, 136, 138, 140, 142, 144, 146, and 148 also connect a completed stacked multi-layer coil transformer to a PC board.

As will become apparent from the following description, solder pads 142, 144, 146, and 148 in the recessed portion of transformer core 100 provide the electrical connection for the coil leads. One skilled in the art will appreciate that transformer core 100 may include more electrical vias or fewer electrical vias and solder pads as a matter of design choice to accommodate additional configurations and stacking formations.

The Coil Former

The coil former of the present invention provides a form on which a coil for transformer core 100 is wound. The coil former also connects E-cores 102 and 104 to form a substantially homogeneous transformer core and provides an electrical link between the coil leads and solder pads 142, 144, 146, and 148.

Figure 2:
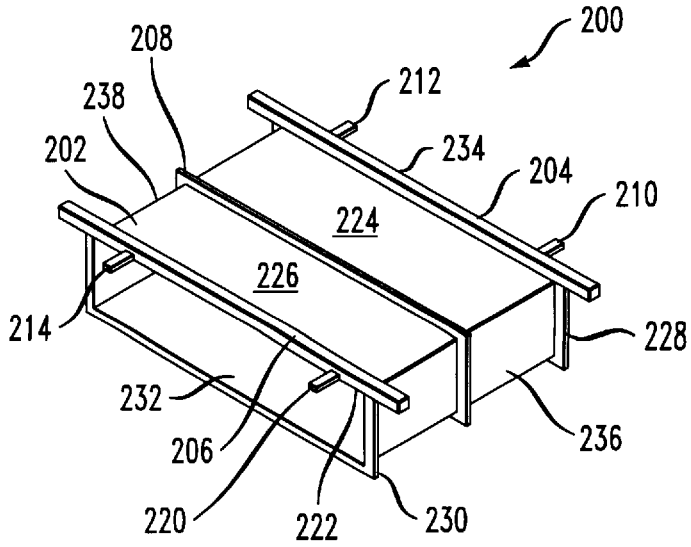
FIG. 2 illustrates an example of a coil former of the present invention.

Referring to FIG. 2, coil former 200 comprises a rectangular casing 202, a first flange 204, second flange 206, partition 208, and a first plurality of metallic pins 210, 212, 214, and 220. Casing 202 includes a central interior cavity 232 formed through casing 202 and dimensioned to accommodate center legs 128 and 106 of E-cores 102 and 104.

Figure 3:
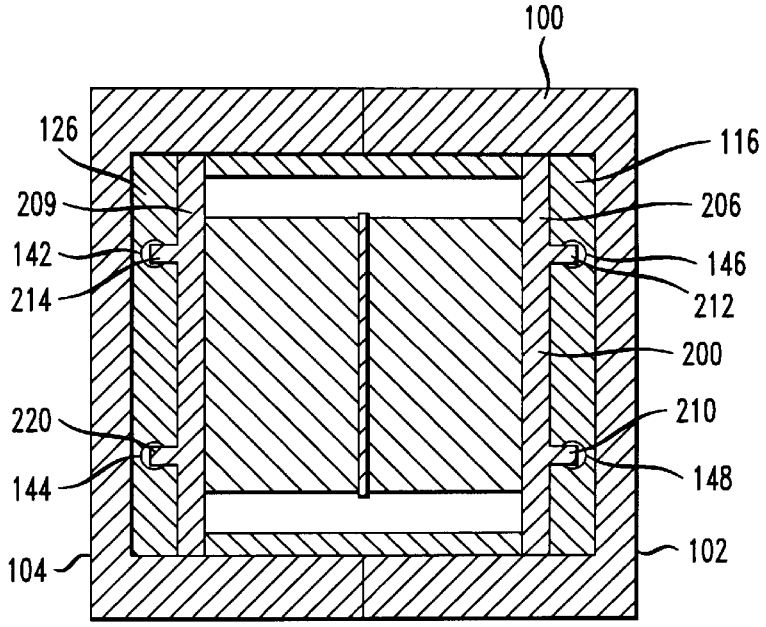
FIG. 3 illustrates a top plan view of a multi-layer transformer core connected by the coil former of FIG. 2.

Flanges 204 and 206 are integrally formed along a first edge and a second edge of casing 202. Flanges 204 and 206 are in parallel relationship to each other and in perpendicular relationship to cavity 232. Flanges 204 and 206 are offset exterior to the edges to form lips 222 and 234 between the edges and flanges 204 and 206. Referring to FIG. 3, flanges 204 and 206 extend beyond ends 236 and 238 of casing 202, the full interior distance of recessed portions 126 and 116 of E-cores 102 and 104. Flanges 204 and 206 align E-cores 102 and 104 during assembly to form transformer core 100.

Referring back to FIG. 2, partition 208 is a centrally located integrally formed wall circumscribing the outer diameter of casing 202 in parallel relationship with flanges 204 and 206. Flanges 204 and 206, together with partition 208, define channels 224 and 226, which also circumscribe the outer diameter of casing 202. Channels 224 and 226 are further defined by partitions 228 and 230. Partitions 228 and 230 are integrally formed walls circumscribing the opposing openings of central cavity 232. Partitions 228 and 230 circumscribe the opening downward from flanges 204 and 206 and mate with flanges 204 and 206 on the opposite end of casing 202. Partitions 228 and 230 should extend far enough beyond ends 236 and 238 to provide additional alignment by contacting the interior edges of legs 108, 110, 112, and 114.

Metallic pins, 210, 212, 214, and 220 connect perpendicular to flanges 204 and 206. Metallic pins, 210, 212, 214, and 220 are configured to align with solder pads 142, 144, 146, and 148 during assembly of a coil transformer. Although metallic pins 210, 212, 214, and 220 could be other configurations as a matter of design choice, they are preferably rectangular in cross section to facilitate connection with the solder pads 142, 144, 146, and 148. Metallic pins, 210, 212, 214, and 220 may be connected to flanges 204 and 206 by any suitable manner including without limitation, an adhesive or compression into holes bored into flanges 204 and 206. Alternatively, additional pins may be added to coil former 200 as a matter of design choice.

Figure 4:
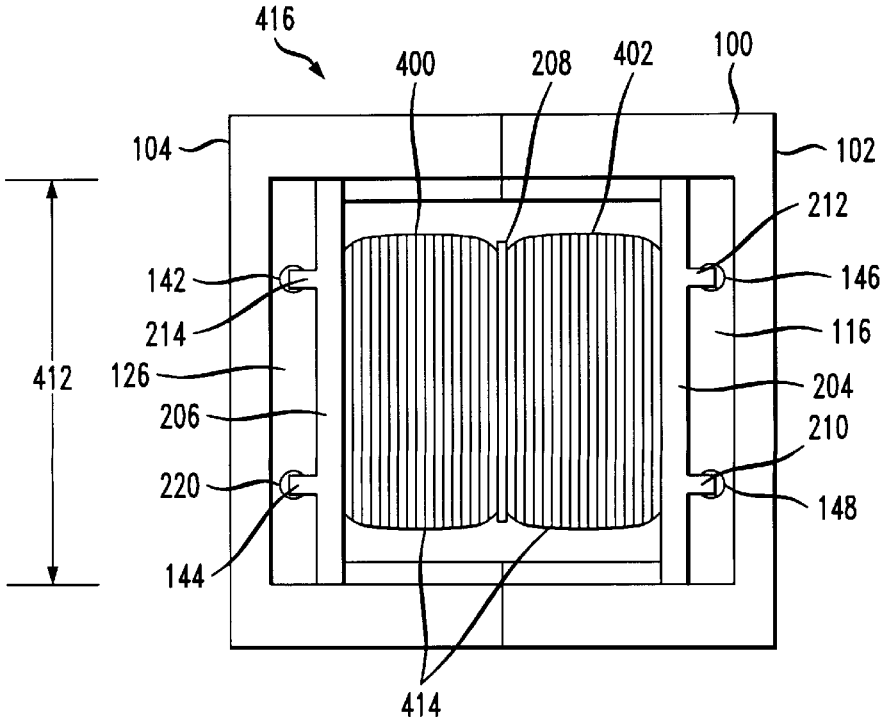
FIG. 4 illustrates a top plan view of a multi-layer coil transformer employing a coil former according to the present invention.

Referring to FIG. 4, coil 414 comprises a primary winding 400 and a secondary winding 402. Primary winding 400 is wound around one of channels 224 and 226, and secondary winding 402 is wound around the other one of channels 224 and 226. Partition 208 provides a physical separation between primary winding 400 and secondary winding 402. The coil leads of primary winding 400 and secondary winding 402 connect to metallic pins 210, 212, 214, and 220 by a solder connection. Alternatively, the coil leads of primary winding 400 and secondary winding 402 could be connected to metallic pins 210, 212, 214, and 220 by wire wrapping. Advantageously, coil former 200 and coil 414 are embedded in recessed portions 126 and 116 so as not to interfere with the stackable configuration of coil transformer 416.

After coil 414 is wound around channels 224 and 226, center legs 106 and 128 of E-cores 102 and 104 are inserted into cavity 232 from opposing sides. The E-cores are compressed together to form transformer 100. Flanges 204 and 206 extend the full interior distance 412 of recessed portions 126 and 116 to align E-cores 102 and 104 during assembly. In addition, partitions 228 and 230 provide support and alignment through contact with the interior edges of legs 108, 110, 112, and 114. When fully assembled, the interior edges of recessed portions 126 and 116, parallel with flanges 204 and 206, are seated in lips 222 and 234 to add additional support and structural integrity to transformer 416. Metallic pins 210, 212, 214, and 220 connect to solder pads 148, 146, 142, and 144 respectively to provide a conductive link between coil 414 and the transformer core 100. Metallic pins 210, 212, 214, and 220 also secure E-cores 102 and 104 in a facial relationship without using bonding agents or other connecting apparatuses.

An especially preferred feature of coil former 200 is improved inductance performance from the substantially homogeneous transformer core formed by coil former 200. Coil former 200 provides the method of securing E-cores 102 and 104 in the facial relationship, eliminating the bonding agent and clip connection used in prior art transformers. Inductance performance in E-core transformers is directly proportional to the contact between the cross section of the legs, e.g. 114 and 112. Inductance in transformers employing coil former 200 is improved by completely eliminating the air gap created by the bonding agent and precisely aligning the E-core legs 106, 108, 110, 112, 114, and 128 during assembly. In addition, eliminating the bonding agent and clip reduces manufacturing steps resulting in lower production and material costs.

Figure 5:
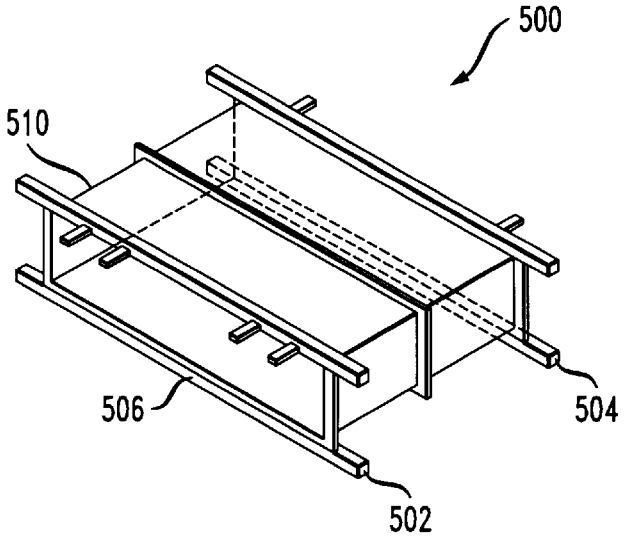
FIG. 5 illustrates another example of a coil former according to the present invention.

FIG. 5 illustrates another example of a coil former according to the present invention, namely coil former 500. Those skilled in the art will appreciate numerous variations that do not depart from the present invention. Those skilled in the art will also appreciate that various features described below could be combined with the above described example to form multiple variations of the invention.

Coil former 500 is identical in design and operation to coil former 200, except that it includes a second pair of flanges, namely third flange 502 and fourth flange 504. Flanges 502 and 504 connect along the bottom edges of casing 510. Flanges 502 and 504 are a mirror image of flanges 204 and 206. Flanges 502 and 504 are offset exterior to the bottom edges of casing 510 to form a lip as illustrated by lip 506 between the bottom edge and flange 502 on FIG. 5.

A preferred feature of this example is that flanges 502 and 504 improve alignment of E-cores 102 and 104 during assembly and adds structural integrity to an assembled coil transformer. Similar to flanges 204 and 206, the recessed portions on E-cores 102 and 104 seat in the lips e.g. 506. Flanges 502 and 504 also extend the full interior distance of the recessed portions to align E-cores 102 and 104 during assembly.

Figure 6:
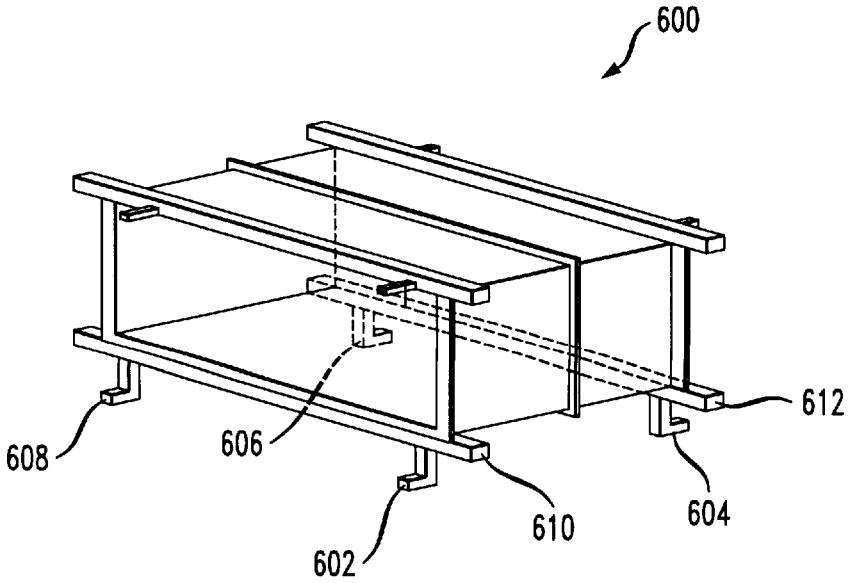
FIG. 6 illustrates another example of a coil former according to the present invention.

FIG. 6 illustrates another example of a coil former according to the present invention, namely coil former 600. Those skilled in the art will appreciate numerous variations that do not depart from the present invention. Those skilled in the art will also appreciate that various features described below could be combined with the above described examples to form multiple variations of the invention.

Coil former 600 could be identical in design and operation to coil former 200 or coil former 500, except that it includes metallic pins 602, 604, 606, and 608. To clarify, metallic pins 602, 604, 606, and 608 could be included on either coil former 200 or coil former 500 as a matter of design choice. Metallic pins 602, 604, 606, and 608 are conventional coil former connection pins and could be connected to flanges 610 and 612 by any suitable manner. Metallic pins 602, 604, 606, and 608 connect an assembled coil transformer to a PC board. Those skilled in the art will appreciate that the metallic pins 602, 604, 606, and 608 could be a straight configuration for through hole mounting on the PC board or an angled configuration for surface mounting on a PC board. Coil former 600 is used with E-cores that do not include electrical vias and solder pads 130, 132, 134, 136, 138, and 140 for connecting the transformer to a PC board.

A preferred feature of this example is that metallic pins 602, 604, 606, and 608 provide the connection for the coil transformer to a PC board. In some cases it is desired to utilize a coil transformer constructed using the coil former of the present invention in a non-stacked configuration, thus eliminating the need for electrical vias and solder pads 130, 132, 134, 136, 138, and 140. Replacing the electrical vias and solder pads 130, 132, 134, 136, 138, and 140 with metallic pins 602, 604, 606, and 608 lowers manufacturing and production costs for coil transformers where a stacked configuration is unnecessary. It should also be noted that in this example, the coil leads could be connected to the metallic pins 602, 604, 606, and 608 by a solder connection or by a wrapped connection to make the electrical connection between the PC board and coil transformer.

Figure 7:
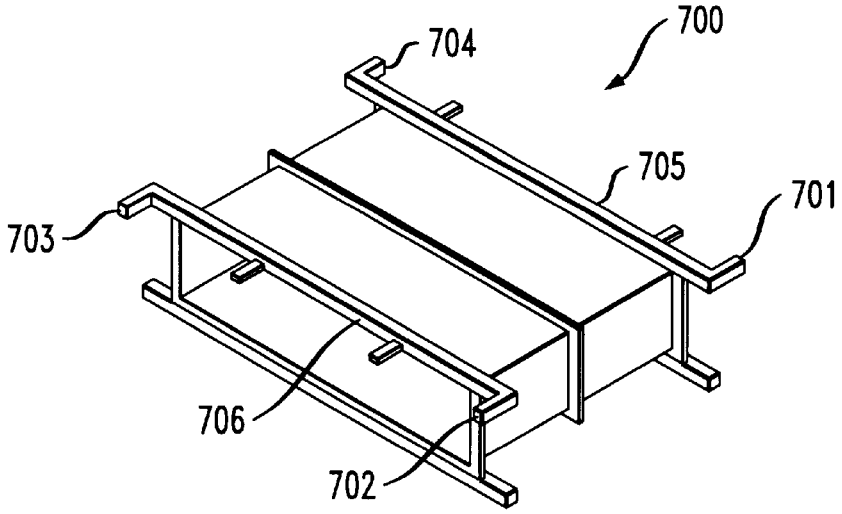
FIG. 7 illustrates another example of a coil former according to the present invention.

FIG. 7 illustrates another example of a coil former according to the present invention, namely coil former 700. Those skilled in the art will appreciate numerous variations that do not depart from the present invention. Those skilled in the art will also appreciate that various features described below could be combined with the above described examples to form multiple variations of the invention.

Coil former 700 could be identical in design and operation to coil former 200, 500 or 600 except that the flanges 705 and 706 of coil former 700 are flared out at a right angle. To clarify, the flared out ends of flanges 705 and 706 could be included on the flanges of coil former 200, 500 or 600 as a matter of design choice. A preferred feature of this example is that the flared flanges 705 and 706 provide additional structural integrity to an assembled coil transformer e.g. 416 without the use of additional bonding agents or clips. Advantageously, the flared flanges 705 and 706 also provide precise alignment of the E-cores 102 and 104 during assembly.

Figure 8:
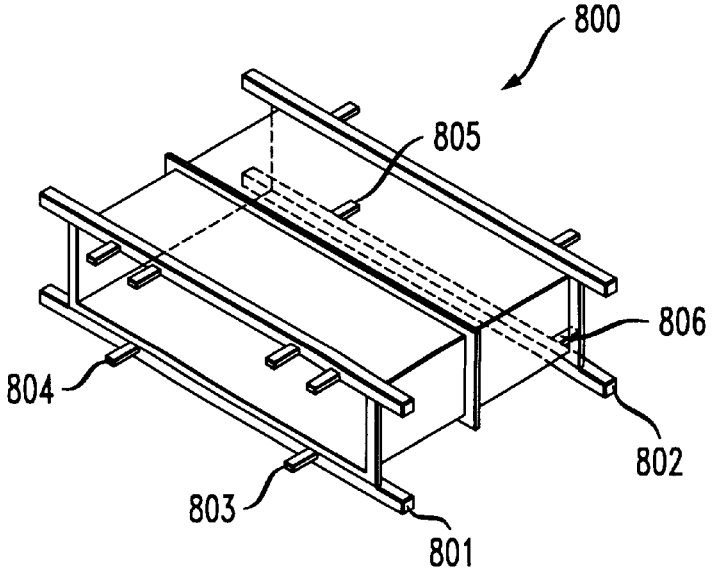
FIG. 8 illustrates another example of a coil former according to the present invention.

FIG. 8 illustrates another example of a coil former according to the present invention, namely coil former 800. Those skilled in the art will appreciate numerous variations that do not depart from the present invention. Those skilled in the art will also appreciate that various features described below could be combined with the above described examples to form multiple variations of the invention.

Coil former 800 could be identical in design and operation to coil former 500 or 600 except that the flanges 801 and 802 of coil former 800 include metallic pins 803, 804, 805, and 806. Metallic pins 803, 804, 805, and 806 are configured to connect to mating electrical vias and solder pads e.g. 142 on the transformer E-cores 102 and 104. Advantageously, the metallic pins 803, 804, 805, and 806 provide additional structural integrity to an assembled coil transformer e.g. 416 without the use of additional bonding agents or clips.

It is apparent that there has been described, a coil former, that fully satisfies the objects, aims, and advantages set forth above. While the coil former has been described in conjunction with specific embodiments thereof, it is evident that many alternatives, modifications, and/or variations can be devised by those skilled in the art in light of the foregoing description. Accordingly, this description is intended to embrace all such alternatives, modifications and variations as fall within the spirit and scope of the appended claims.

What is claimed is:

1. A coil former for use coil transformers, the transformers being formed by a pair of transformer cores having a center leg and two outer legs spaced apart from the center leg and configured to connect in a facial relationship relative to each other, the coil former comprising:

a casing, comprising:

a rectangular casing defining a central interior cavity formed through the casing, a pair of channels integrally formed and circumscribing an outer diameter of the casing in perpendicular relationship to the central cavity, a pair of flanges, including a first flange integrally formed along a first edge and a second flange integrally along a second edge of the casing in parallel relationship with the pair of channels, a second pair of flanges, including a third flange integrally formed along a third edge and a fourth flange integrally formed along a fourth edge of the casing in parallel relationship with the pair of channels;

means within the casing for forming a coil;

means within the casing for connecting the pair of transformer cores to form a homogeneous transformer core;

means within the casing for connecting leads from the coil to the homogeneous transformer core and a printed circuit board, comprising:

a first plurality of pins connected to the casing perpendicular to the first pair of flanges, the first plurality of pins providing a conductive link between the coil and the homogeneous transformer core for connecting the leads of the coil to the homogeneous transformer core, a second plurality of pins connected to the casing perpendicular to the second pair of flanges and at a right angle to the first plurality of pins, the second plurality of pins providing a conductive link between the coil transformer and the printed circuit board.

2. The coil former of claim 1, further comprising:

means within the casing for physically separating a primary winding and a secondary winding of the coil.

3. The coil former of claim 2, wherein the separating means comprises:

a partition integrally formed and circumscribing the outer diameter of the casing between the pair of channels and in parallel relationship to the pair of channels for separating the primary winding and the secondary winding of the coil.

4. A coil transformer, comprising:

a pair of transformer cores;

a coil former connected between the pair of transformer cores to form a homogeneous transformer core, comprising:

a rectangular casing defining a central interior cavity formed through the casing, a pair of channels integrally formed and circumscribing an outer diameter of the casing in perpendicular relationship to the central cavity, a partition integrally formed and circumscribing the outer diameter of the casing between the pair of channels and in parallel relationship to the pair of channels, a pair of flanges, including a first flange integrally formed along a first edge of the casing and a second flange integrally formed along a second edge of the casing in parallel relationship with the pair of channels;

a coil disposed around the coil former and connected to the transformer core; and means within the transformer core for connecting the coil transformer to a printed circuit board, comprising:

a first plurality of pins connected to the casing perpendicular to the flanges and parallel with the central cavity, the first plurality of pins being connected to the transformer core and providing a conductive link between the coil and the transformer core, a first plurality of electrical vias formed in the first transformer core in perpendicular orientation to a center leg and two outer legs, a second plurality of electrical vias formed in the second transformer core in perpendicular orientation to a center leg and two outer legs, the electrical vias providing a conductive link between the coil transformer and the printed circuit board.

5. The transformer of claim 4, wherein the pair of transformer cores comprise:

a first transformer core; and a second transformer core, the first transformer core and the second transformer core each comprising a body having a center leg and two outer legs spaced apart from the center leg and connected to the body.

6. The transformer of claim 5, wherein the center leg of the first transformer core and the center leg of the second transformer core are configured to insert into opposing ends of the central cavity in a facial relationship, and the two outer legs of the first transformer core and the two outer legs of the second transformer core are configured to join in a facial relationship to enclose the coil former between the first transformer core and second transformer core.

7. The transformer of claim 5 wherein a first portion of the first plurality of pins connect to the first transformer core and a second portion of the first plurality of pins connect to the second transformer core to connect the coil former between the first transformer core and the second transformer core and form the homogeneous transformer core.

8. The transformer of claim 4, wherein the coil former further comprises:

a second pair of flanges, including a third flange integrally formed along a third edge of the casing and a fourth flange integrally formed along a fourth edge of the casing in parallel relationship with the pair of channels.

9. The transformer of claim 4, wherein the coil comprises:

a primary winding around one of the pair of channels;

a secondary winding around the other one of the pair of channels; and coil leads forming the ends of the primary winding and the secondary winding, the coil leads being connected to the first plurality of pins.

* * * * *